US011512429B2

(12) United States Patent
Lindblom

(10) Patent No.: US 11,512,429 B2
(45) Date of Patent: Nov. 29, 2022

(54) STEAM EVACUATION IN A PULP OR FIBER REFINER

(71) Applicant: Valmet AB, Sundsvall (SE)

(72) Inventor: Thommy Lindblom, Hägersten (SE)

(73) Assignee: Valmet AB

( * ) Notice: Subject to any disclaimer, the term of this patent is extended or adjusted under 35 U.S.C. 154(b) by 370 days.

(21) Appl. No.: 16/619,251

(22) PCT Filed: Jun. 18, 2018

(86) PCT No.: PCT/SE2018/050636
§ 371 (c)(1),
(2) Date: Dec. 4, 2019

(87) PCT Pub. No.: WO2018/236269
PCT Pub. Date: Dec. 27, 2018

(65) Prior Publication Data

US 2020/0149221 A1 May 14, 2020

(30) Foreign Application Priority Data

Jun. 19, 2017 (SE) ..... 1750776-5

(51) Int. Cl.
*D21D 1/30* (2006.01)

(52) U.S. Cl.
CPC ..... *D21D 1/306* (2013.01)

(58) Field of Classification Search
USPC ..... 162/23, 28; 241/261.2, 197, 186.4
See application file for complete search history.

(56) References Cited

U.S. PATENT DOCUMENTS 4,221,631 A 9/1980 Hellerqvist et al.
4,725,336 A * 2/1988 Fisher ..... D21D 1/30 162/23

(Continued)

FOREIGN PATENT DOCUMENTS

EP 0877117 A2 11/1998
WO 8803189 A1 5/1988

(Continued)

OTHER PUBLICATIONS

Extended European Search Report for Application EP18821128 dated Feb. 10, 2021, 3 pages.

(Continued)

*Primary Examiner* — Jacob T Minskey
(74) *Attorney, Agent, or Firm* — Lerner, David, Littenberg, Krumholz & Mentlik, LLP

(57) ABSTRACT

A first refining disc (5) for a defibrator (1) for refining fibrous material, adapted to receive a flow of incoming fibrous material (7) from a feed screw (3*a*) through a material inlet opening (4) arranged in the first refining disc (5), is provided with at least one steam evacuating channel (21) comprising at least one steam inlet opening (22) arranged on a side of the first refining disc (5) adapted to face a second refining disc (6), and at least one steam outlet opening (23) arranged on a side of the first refining disc (5) adapted to face away from the second refining disc (6). The at least one steam outlet opening (23) is arranged centrally of the at least one steam inlet opening (22) with respect to the center of the first refining disc (5), and centrally of a position where the flow of incoming material (7) is to be received into the first refining disc (5) from the feed screw (3*a*), with respect to the center of the first refining disc (5).

7 Claims, 9 Drawing Sheets

(56) References Cited

U.S. PATENT DOCUMENTS

| | | | |
|---|---|---|---|
| 5,988,538 | A | 11/1999 | Bartels |
| 2007/0164143 | A1 | 7/2007 | Sabourin et al. |

FOREIGN PATENT DOCUMENTS

| | | | |
|---|---|---|---|
| WO | 9833594 | A1 | 8/1998 |
| WO | 2017061936 | A1 | 4/2017 |

OTHER PUBLICATIONS

International Search Report from Application No. PCT/SE2018/050636 dated Sep. 10, 2018, 4 pages.

* cited by examiner

STEAM EVACUATION IN A PULP OR FIBER REFINER

CROSS-REFERENCE TO RELATED PATENT APPLICATIONS

The present application is a national phase entry under 35 U.S.C. § 371 of International Application No. PCT/SE2018/050636 filed Jun. 18, 2018, published in English, which claims priority from Swedish Application No. 1750776-5 filed Jun. 19, 2017, all of which are incorporated herein by reference.

TECHNICAL FIELD

The present invention generally relates to refining of fibrous material in a pulp or fiber refiner, and more particularly to evacuation of steam developed during the refining process.

BACKGROUND

A defibrator is a thermomechanical pulping refiner in which the pulp material, such as wood chips or other lignocellulose-containing fibrous material, is ground in an environment of steam between two refining discs, a rotating grinding disc (rotor) opposing a stationary disc (stator), or alternatively, two rotating discs opposing one another, to produce wood fibers. The refining discs are aligned along a pulp feeding axis and the rotating disc is arranged on a rotatable axis that can be rotated relative to the other disc by means of e.g. an electrical motor. The inner surfaces, i.e. the surfaces opposing one another, of the refining discs are typically provided with one or more refining segments having refining bars and grooves of different sizes and orientations, for improving the grinding action on the fibers. A refining space is defined between the inner (refining) surfaces of the refining segments, which are typically located near the circumference of the refining discs. Wood chips or similar fibrous material is fed via a feeding channel along the pulp feeding axis through a hole in one of the discs, usually the stator, and into a central space between the discs. Wood chips fed into the center of the refining discs are forced by the centrifugal force towards the circumference of the discs to emerge in the refining space between the refining surfaces of the refining segments, where the refining/grinding of the fibrous material is performed. The bars and grooves of the refining segments are usually finer nearer the circumference of the discs. The size of the refined fibers can to some extent be controlled by altering the distance between the discs and thus the refining surfaces where a closer distance produces finer fibers but also requires higher grinding force.

Generally, the lignocellulose-containing material contains water since the wood chips are usually steamed with hot water and/or steam before being introduced into the defibrator. Further, water may be supplied in connection with the refining. From this water, a great amount of steam is generated in the refining space during the refining operation of the fibrous material, since the grinding of the material requires a lot of energy due to the extensive friction and generates a lot of heat which evaporates the water. The generated steam may pass out of the refining space together with the refined material, and may also flow backwards towards the location where the incoming chips are fed into the defibrator. The steam flow through the refining space assumes a very high speed and can negatively affect the flow of fibrous material and also increase the energy consumption of the refiner. The steam may also flow in an irregular manner and thereby affect the stability of the refining gap, rendering the material flow through the gap non-uniform. This has a negative effect on the pulp quality. Therefore, it is important to minimize the disturbance from the steam developed during the refining process.

Previous efforts to alleviate the problems associated with the generation of steam between the refining discs have involved withdrawing steam from the central space between the refining discs. For example, U.S. Pat. No. 4,221,631 A shows a disc refiner comprising a pair of refining discs each of which has an inner refining surface. The refining surfaces are opposing each other during relative rotation of the discs and define a refining space between them. The refining segments are provided with passageways extending through the segments from the refining space to the rear surface of the segments for removing steam developed in the refining space and releasing it into the refining housing.

However, there is continued need in the art to further improve the evacuation of steam from the refining space of the refiner.

SUMMARY

It is an object to provide a refining disc which further improves the evacuation of steam developed during the refining process.

This and other objects are met by embodiments of the proposed technology.

According to a first aspect, there is provided a first refining disc for a defibrator for refining fibrous material, where the first refining disc is adapted to receive a flow of incoming fibrous material from a feed screw. The first refining disc is provided with at least one steam evacuating channel comprising at least one steam inlet opening arranged on a side of the first refining disc adapted to face a second refining disc, and at least one steam outlet opening arranged on a side of the first refining disc adapted to face away from the second refining disc. The at least one steam outlet opening is arranged centrally of the at least one steam inlet opening with respect to the center of the first refining disc, and peripherally and/or centrally of a position where the flow of incoming material is to be received into the first refining disc from the feed screw, with respect to the center of the first refining disc.

According to a second aspect, there is provided a center ring arrangeable on a first refining disc for a defibrator for refining fibrous material, where the first refining disc is adapted to face a second refining disc and to receive a flow of incoming fibrous material from a feed screw. The center ring is provided with at least one steam evacuating channel comprising at least one steam inlet opening arranged on a side of the center ring adapted to face the second refining disc, and at least one steam outlet opening arranged on a side of the center ring adapted to face away from the second refining disc. The at least one steam outlet opening is arranged centrally of the at least one steam inlet opening with respect to the center of the center ring, and the at least one steam outlet opening is configured to be positioned peripherally and/or centrally of a position where the flow of incoming material is to be received into the first refining disc from the feed screw, with respect to the center of the first refining disc.

According to a third aspect, there is provided a defibrator for refining fibrous material, comprising a refining disc according to the above.

By introducing a steam evacuation channel according to the present invention, thereby facilitating evacuation of steam from the defibrator without disturbing the chip feed, at least the following advantages can be achieved:

Less turbulence and losses, resulting in better and more stable feed of wood chips Less micro-pulsation Less build-ups of fiber in the center plate and ribbon feeder In turn, the above leads to lower specific energy consumption (SEC), more uniform fiber quality and longer segment lifetimes.

Other advantages will be appreciated when reading the detailed description.

BRIEF DESCRIPTION OF THE DRAWINGS

The invention, together with further objects and advantages thereof, may best be understood by making reference to the following description taken together with the accompanying drawings, in which.

DETAILED DESCRIPTION

Throughout the drawings, the same reference designations are used for similar or corresponding elements.

As described in the background section there is continued need in the art to further improve the evacuation of steam from the refining area of the refiner.

Figure 1:
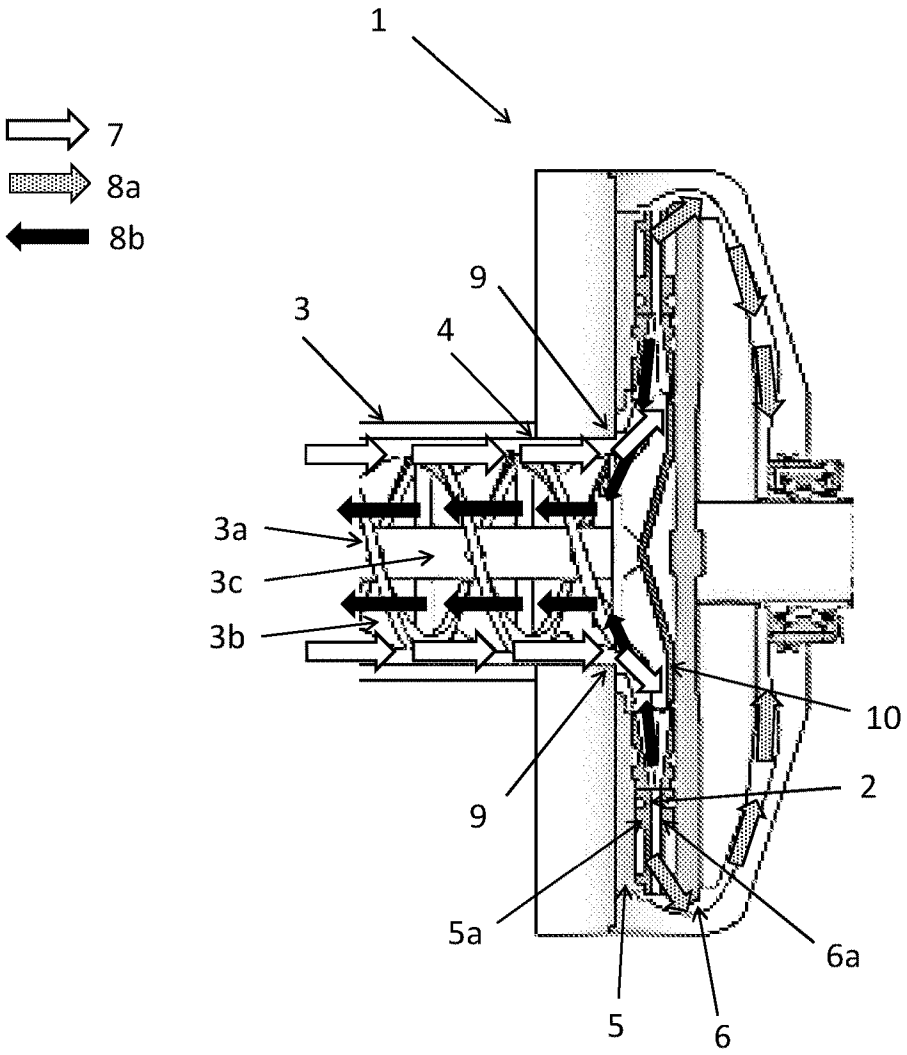
FIG. 1 is a schematic illustration of a typical defibrator in a refiner according to prior art technology.

FIG. 1 is a schematic illustration of a typical defibrator arrangement in a pulp or fiber refiner. Here, a defibrator with a rotor and a stator arrangement is described, but the present embodiments may also be applied in a defibrator with two rotors. Lignocellulose-containing material 7, such as wood chips, is fed by a conveyor screw/feed screw 3*a*, usually a ribbon feeder, via a feeding channel 3 towards the defibrator 1 and through a material inlet opening 4 in the stator 5 into a central space between the refining discs, i.e. the stator 5 and the rotor 6. The centrifugal force forces the material towards the circumference of the refining discs to emerge in the refining gap/space 2 between the refining surfaces of the refining segments of the refining discs. When the lignocellulose-containing material is refined in the refining gap/space 2 between the refining segments 5*a*, 6*a* of the stator 5 and the rotor 6, some of the moisture in the chips/fiber is turned into steam. The steam flow is usually very irregular, but some steam 8*a* will flow forwards in the same direction as the material 7, and some of the steam 8*b* will also flow backwards towards the center of the refining discs. The steam flow will depend—among other things—on how the refining segments are designed. To facilitate evacuation of steam from the defibrator, the feed screw 3*a* is usually a ribbon feeder which has a center cavity 3*b*, surrounding the center axis 3*c*, for allowing steam to flow backwards from the defibrator 1 and escape through the feed screw 3*a*, as illustrated in FIG. 1. Experience shows that the flow of fibrous material is following acceleration (rotation/centrifugal forces) since the material has weight. Therefore, the fibrous material ends up primarily in the periphery of the ribbon feeder and is fed forwards, whereas back-streaming steam 8*b* with less or almost no weight is travelling backwards primarily in the center cavity 3*b* of the ribbon feeder.

However, in order to escape through the feed screw the steam formed between the rotor and the stator first has to find its way back towards the center of the rotor and stator, working against the flow of material being fed in the opposite direction, as illustrated in FIG. 1. Lignocellulose-containing material 7 is fed by the feed screw 3*a* into a central space between the stator 5 and rotor 6, and is then directed by the centrifugal forces into the refining gap/space 2 and further towards the periphery of the stator 5 and rotor 6, where the refined fibers 7*b* are ejected from the defibrator. The refining surfaces of the stator 5 and/or rotor 6 typically comprise a number of different refining segments 5*a*, 6*a* having a pattern of refining bars and intermediate grooves of different sizes and orientations, for improving the grinding action on the fibers. The grooves formed between the bars are also guiding back-streaming steam towards the center of the rotor 6 and stator 5. The rotor 6 may also be provided with a center plate 10, which is arranged at the rotational center of the rotor 6, on the side of the rotor 6 facing the stator 5. The purpose of the center plate 10 is to help feeding the fibrous material 7 towards the periphery of the rotor 6 and stator 5. The surface of a center plate is typically provided with a set of feeding bars or "wings" or wing profiles, whose purpose is to direct the fibrous material more evenly towards the rim/periphery of the stator-rotor arrangement.

Following the same reasoning as above, due to the weight of the material most of the material flow will be carried by the rotor, whereas the lighter steam flowing backwards will follow the stator side, as illustrated in FIG. 1. Therefore, the back-streaming steam 8*b* must pass through the flow of material 7 on its way to the center of the ribbon feeder 3*a*, thus causing a feed conflict 9 which results in turbulence and losses. This feed conflict results in unnecessary restriction of the steam flow which causes higher energy consumption, feed variations of the material flow which causes lower fiber quality as well as higher energy consumption.

Therefore, the aim of the present invention is to provide a way for steam to be evacuated from the refining space without passing through the flow of incoming material, in order to avoid the feed conflict between the material flow and the back-streaming steam.

This is accomplished by providing a refining disc with at least one steam evacuating channel adapted to evacuate back-streaming steam from the refining space, transport it towards the center of the refining disc and release it outside of the refining space either peripherally or centrally of the flow of incoming material. In this way the steam is separated from the material flow and a feed conflict between the steam and the material can be avoided.

Figure 2B:
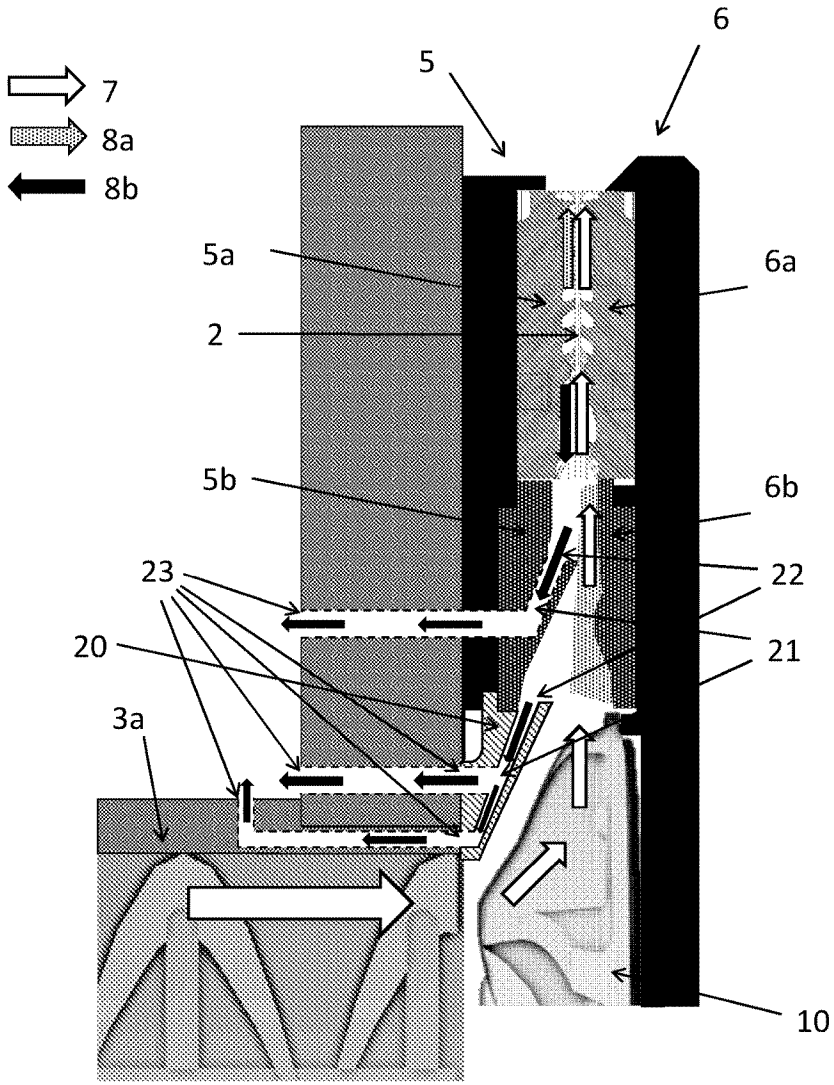
FIGS. 2*b*-2*d* are schematic illustrations of material flow and steam flow in a defibrator according to different embodiments of the present disclosure.
Figure 2A:
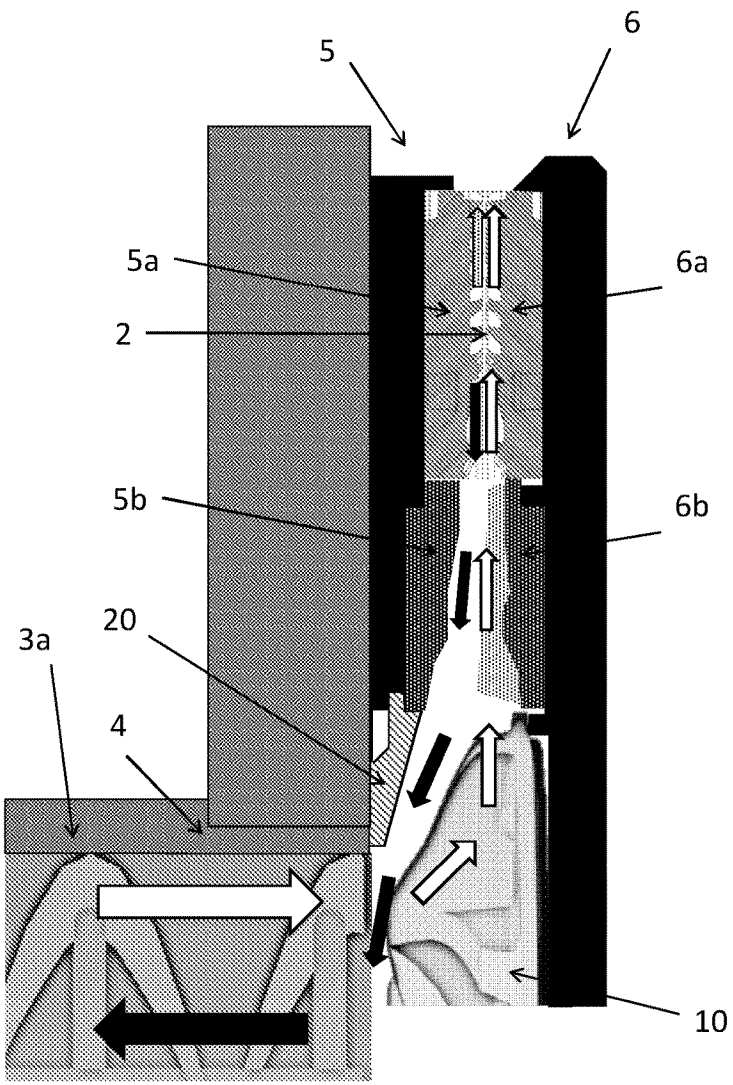
FIG. 2*a* is a schematic illustration of material flow and steam flow in a typical defibrator according to prior art technology.

FIG. 2*a* is a schematic illustration of a part of typical defibrator according to prior art. The lignocellulose-containing material 7 is fed by the feed screw/ribbon feeder 3*a* into the central space between the refining discs 5, 6 and is forced by the centrifugal force into the refining space 2 between the refining surfaces of the refining segments 5*a*, 6*a*, of the refining discs 5, 6. As described above, some of the steam created in the refining space 2 is flowing forwards 8*a* in the same direction as the material 7, but the back-streaming steam 8*b* flows backwards towards the center of the refining discs 5, 6 and must pass through the flow of material 7 on its way to the center of the ribbon feeder 3*a*, causing a feed conflict.

According to the present disclosure, this feed conflict can be avoided by evacuating the back-streaming steam out of the defibrator through one or more steam evacuating channels provided in one of the refining discs. Such a steam evacuating channel has at least one steam inlet opening arranged on the side of the refining disc facing the other refining disc, and at least one steam outlet opening arranged on the opposite side of the refining disc and centrally of the at least one steam inlet opening, and either peripherally or centrally of the flow of incoming material, with respect to the center of the refining disc. FIG. 2*b* shows some examples of such steam evacuating channels 21 according to different embodiments. The different embodiments are illustrated with dashed lines to indicate that they are alternative solutions that can be applied separately, but they can also be applied together in different combinations.

The steam evacuating channel(s) 21 should preferably be provided in the refining disc 5 that the back-streaming steam 8*b* is travelling along, in order to "catch" more of the steam flowing along the surface of the refining disc 5. Usually the back-streaming steam will mainly be carried by the stator, as described above. Thus, in an embodiment the at least one steam evacuating channel 21 is provided in the stator 5.

As schematically illustrated in FIG. 2*b*, the back-streaming steam 8*b* enters into a steam evacuating channel 21 via a steam inlet opening 22 arranged on the side of the refining disc 5 facing the other refining disc 6. The steam is then released from the steam evacuating channel 21 via at least one steam outlet opening 23 arranged on the opposite side of the refining disc 5, i.e. the side of the refining disc 5 facing away from the other refining disc 6.

In the embodiments of FIG. 2*b* the steam inlet openings 22 are arranged centrally of the refining segments 5*a* of the refining disc 5 with respect to the center of the refining disc 5. This location of the steam inlet openings 22 is advantageous because it is difficult to know exactly where in the refining space 2 steam is generated and in which direction steam is flowing within the refining space 2, and it would therefore be difficult to catch all of the back-streaming steam 8*b* if the steam inlet openings 22 were located e.g. within the refining segment 5*a*. By arranging steam inlet opening(s) 22 centrally of the refining segment 5*a*, there is a better chance of catching the back-streaming steam 8*b*. As schematically illustrated in FIG. 2*b*, a steam inlet opening 22 may have an edge or "lip" protruding towards the second refining disc 6, so that the edge or lip extends into the space between the refining discs 5, 6 in order to guide more of the steam into the channel 21.

Furthermore, in some embodiments at least a part of the steam evacuating channel(s) 21, preferably the first part as seen from the steam inlet opening 22, is arranged at an acute angle with respect to the inner surface of the refining disc 5, where the inner surface of the first refining disc (5) is facing the second refining disc (6). Thus, the back-streaming steam 8*b* is smoothly guided into the channel 21 and towards the center of the refining disc 5 without an abrupt change in direction, as illustrated in FIG. 2*b*.

In the embodiments illustrated in FIG. 2*b* the steam evacuating channels 21 are arranged through the refining disc 5 and/or the stator plate and/or the ribbon feeder 3*a*. The steam is then released at the opposite side of the refining disc 5 via at least one steam outlet opening 23 arranged on the opposite side of the refining disc 5. In the embodiments of FIG. 2*b*, the steam outlet opening(s) 23 may be arranged peripherally of the flow of incoming material 7 with respect to the center of the refining disc (5). In a particular embodiment the steam outlet opening(s) 23 may be arranged peripherally of the material inlet opening 4 in the refining disc 5. Thus, the back-streaming steam 8*b* is evacuated from the refining space 2 without passing through the flow of material 7.

In some embodiments the refining disc comprises a center ring and at least one steam channel may then be provided in the center ring. The segments of a refining disc are often replaceable and the purpose of a center ring is to hold the segments in place. Usually a center ring is arranged on the stator side of the defibrator. An example of a center ring according to prior art is shown in FIGS. 2*a*, 3*a*, 4*a* and 5*a*. As illustrated in the figures, a center ring 20 is typically circular and has a cross-sectional shape with a flat side and a side that is tapered so that the ring is thicker at the circumference and narrower towards the center of the ring. As can be seen from the figures, the center ring 20 is typically placed with its flat side against the refining disc 5. The center ring is also provided with cut-outs and/or flanges adapted to fit e.g. with a holder 5*c* of the refining disc 5 and the center segments 5*b* of the refining disc 5. As illustrated in FIG. 5*a*, the center ring 20 is arranged so that the rotational center of the center ring 20 coincides with the center of the center axis 3*c* of the feed screw 3*a* when the center ring 20 is placed on the refining disc 5.

Some examples of embodiments of center rings for a refining disc according to the present disclosure are shown in FIGS. 2*b*-2*d*, 3*b*, 4*b*-4*d* and 5*b*-5*d*. In all these embodiments at least one steam evacuating channel 21 is provided in the center ring 20, where the steam channel 21 comprises at least one steam inlet opening 22 arranged on the side of the center ring 20 facing the other refining disc 6, and at least one steam outlet opening 23 arranged on the opposite side of the center ring 20, i.e. when the center ring 20 is mounted on the refining disc 5 the steam inlet opening 22 will be located on the side of the refining disc 5 facing the other refining disc 6 and the steam outlet opening 23 will be located on the opposite side of the refining disc 5, similarly to the above-described embodiments of a refining disc without a center ring. The at least one steam outlet opening 23 is arranged centrally of the at least one steam inlet opening 22 with respect to the center of the center ring 20.

In some embodiments, as illustrated in FIG. 2*b*, the steam outlet opening(s) 23 provided in the center ring 20 may arranged peripherally of the flow of incoming material 7 with respect to the center of the refining disc 5. In a particular embodiment at least one steam outlet opening 23 may be arranged peripherally of the material inlet opening 4 in the refining disc 5. In other embodiments, as illustrated in FIGS. 2*c*-*d*, 3*b*, 4*b*-*d* and 5*b*-*d*, the steam outlet opening(s) 23 may instead be arranged centrally of the flow of incoming material 7 with respect to the center of the refining disc 5. The different embodiments shown in FIGS. 2*b*-*d*, 3*b*, 4*b*-*d* and 5*b-d* may also be combined so that there are steam outlet openings 23 arranged both centrally and peripherally of the flow of incoming material.

Figure 2D:
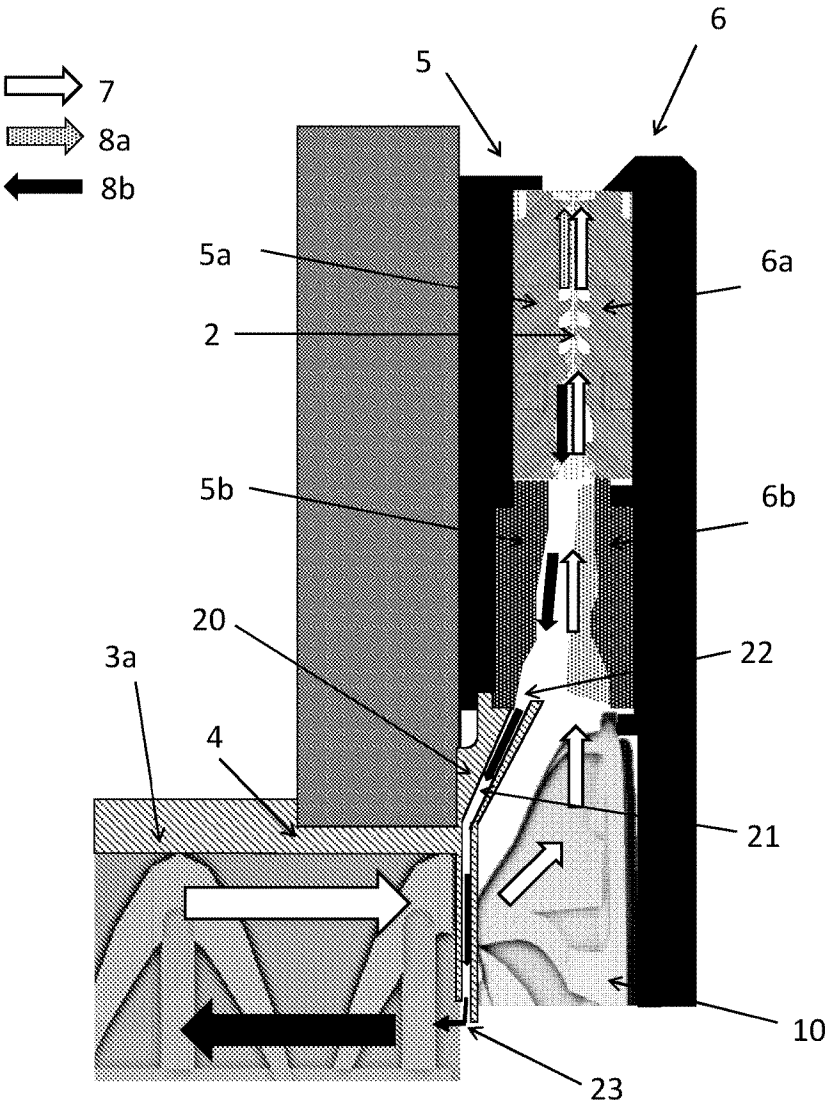
Figure 2C:
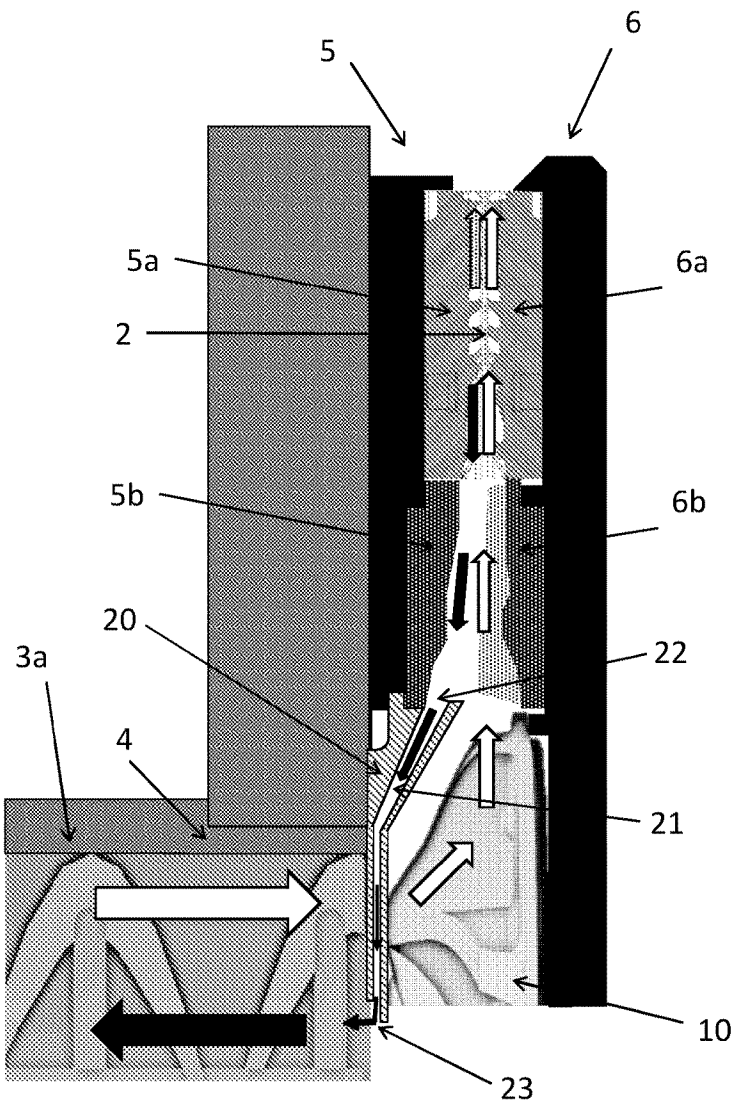
Figure 3B:
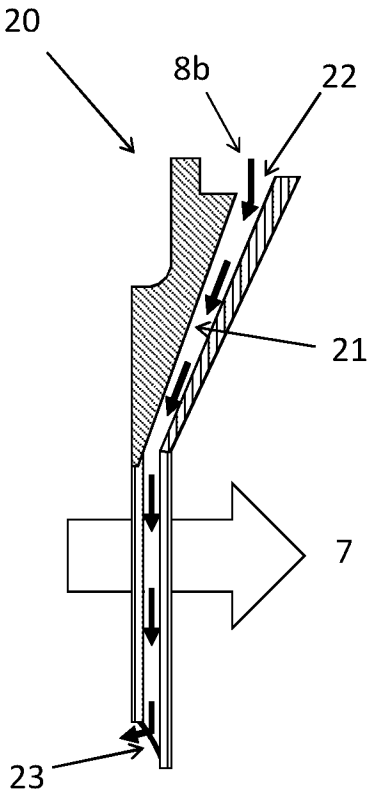
FIG. 3*b* is an enlarged illustration of material flow and steam flow around a center ring according to an embodiment of the present disclosure.
Figure 3A:
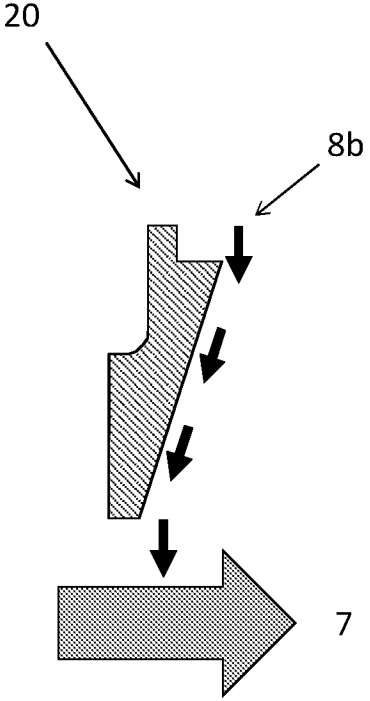
FIG. 3*a* is an enlarged illustration of material flow and steam flow around a center ring according to prior art technology.

Common for all of the embodiments of a center ring 20 illustrated in FIGS. 2*c-d*, 3*b*, 4*b-d* and 5*b-d*, is that the steam can be evacuated from the refining space without passing through the flow of incoming material. FIGS. 3*a* and 3*b* illustrates the difference in material flow 7 and steam flow 8*b* around a center ring 20 according to prior art (FIG. 3*a*) and a center ring 20 according to an embodiment of the present disclosure (FIG. 3*b*). According to prior art technology, as illustrated in FIG. 3*a*, the back-streaming steam 8*b* flowing along the center ring 20 on its way towards the center of the feed screw will cross the flow of incoming material 7, thereby causing a feed conflict. In contrast, as illustrated in FIG. 3*b*, the center ring 20 according to an embodiment will instead guide the back-streaming steam 8*b* via a steam inlet opening 22 through the steam evacuating channel 21 and release it via a steam outlet opening 23 arranged centrally of the flow of incoming material 7, thereby avoiding a feed conflict.

In a particular embodiment, as schematically illustrated in FIG. 2*d*, the center ring 20 may constitute a part of the ribbon feeder 3*a*. In other embodiments, a center ring 20 according to the present disclosure may be fitted to a standard refining disc according to well-known technology.

Figure 4D:
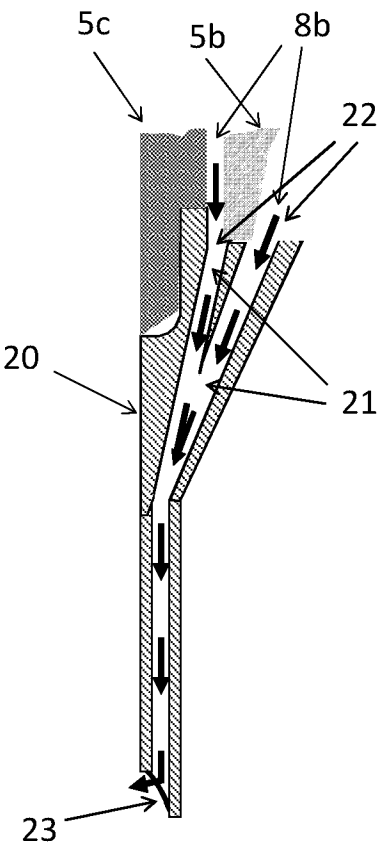
FIGS. 4*b*-4*d* are schematic illustrations of different embodiments of a center ring for a refining disc according the present disclosure.
Figure 4C:
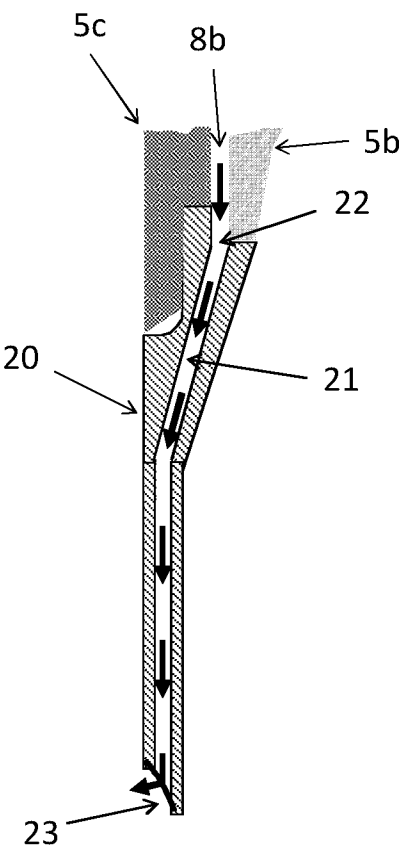
Figure 4B:
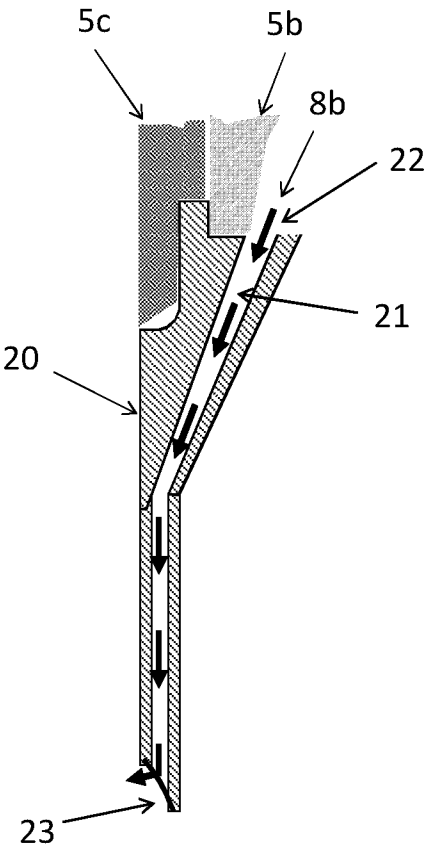
Figure 4A:
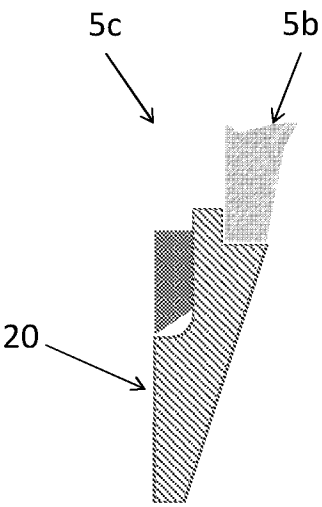
FIG. 4*a* is a schematic illustration of a center ring for a refining disc according to prior art technology.
Figure 5A:
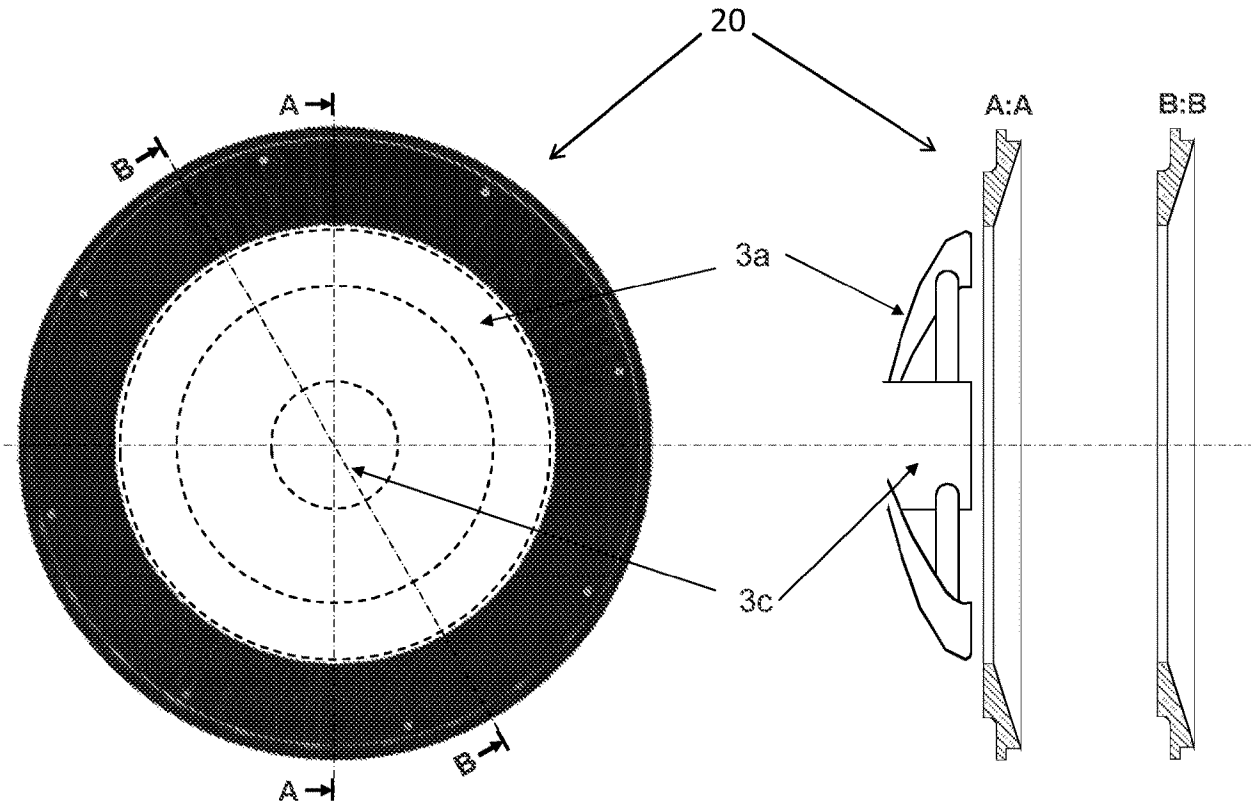
FIG. 5*a* is a schematic illustration of a center ring for a refining disc according to prior art technology.

FIG. 4*a* illustrates a typical center ring according to prior art and FIGS. 4*b-d* illustrate different embodiments of a center ring according to the present disclosure. The figures show the center ring 20, a holder 5*c* of a refining disc and a center segment 5*b* of a refining disc. In different embodiments one or more steam inlet openings 22 may be arranged on a side of the center segment 5*b* facing the other refining disc 6, as illustrated in FIG. 4*b*, or between the center segment 5*b* and the holder 5*c*, as illustrated in FIG. 4*c*, or a combination of both as illustrated in FIG. 4*d*. If there are multiple steam inlet openings 22, the steam evacuating channel 21 may at least partly be divided into multiple channels 21 leading from a respective steam inlet opening 22. As illustrated in FIG. 2*b*, the center ring 20 may also be provided with multiple steam outlet openings 23.

In some embodiments of a center ring 20 according to the present disclosure, at least a part of the steam evacuating channel(s) 21, preferably the first part as seen from the steam inlet opening 22, is arranged at an acute angle with respect to the flat side of the center ring 20, i.e. at an acute angle with respect to the inner surface of the refining disc 5, similarly to the above-described embodiments of a refining disc without a center ring. Also, a steam inlet opening 22 may have an edge or "lip" protruding towards the second refining disc 6, so that the edge or lip extends into the space between the refining discs 5, 6 in order to guide more of the steam into the channel 21.

Figure 5B:
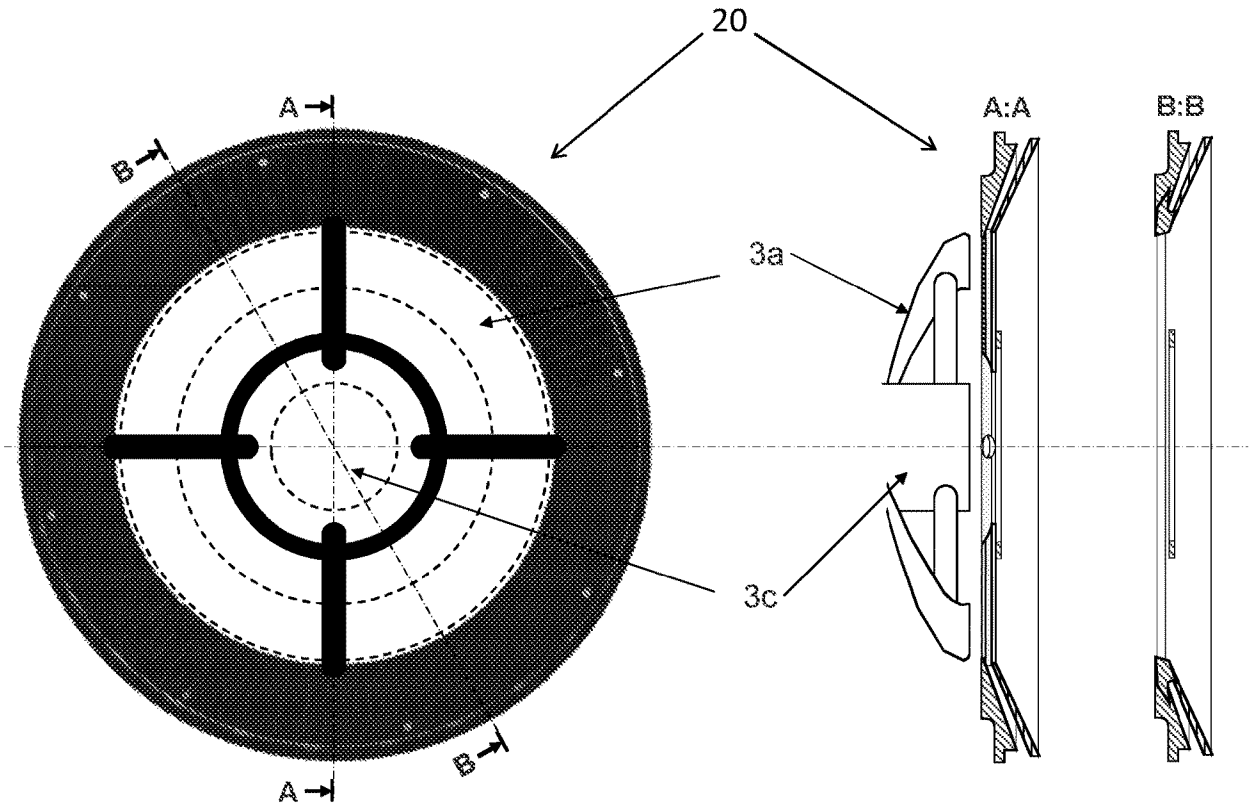
FIGS. 5*b*-5*d* are schematic illustrations of different embodiments of a center ring for a refining disc according the present disclosure.
Figure 5C:
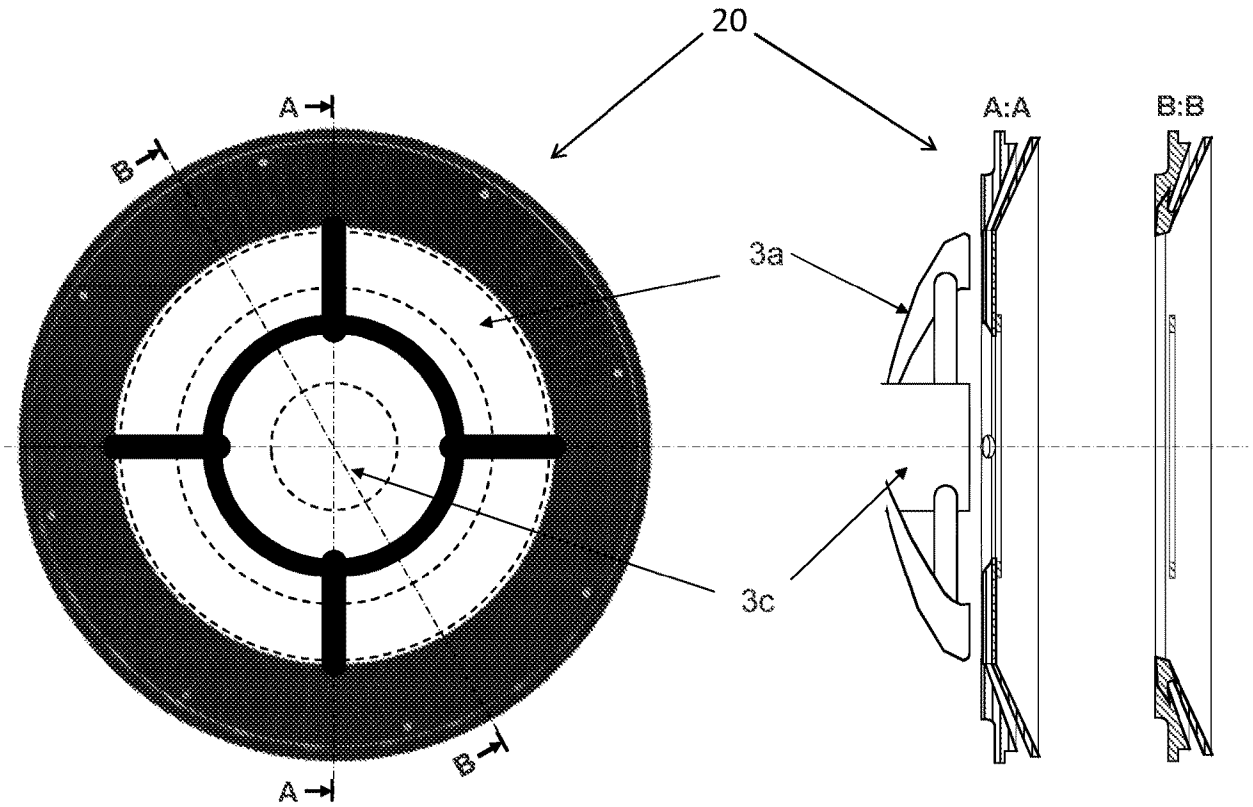
Figure 5D:
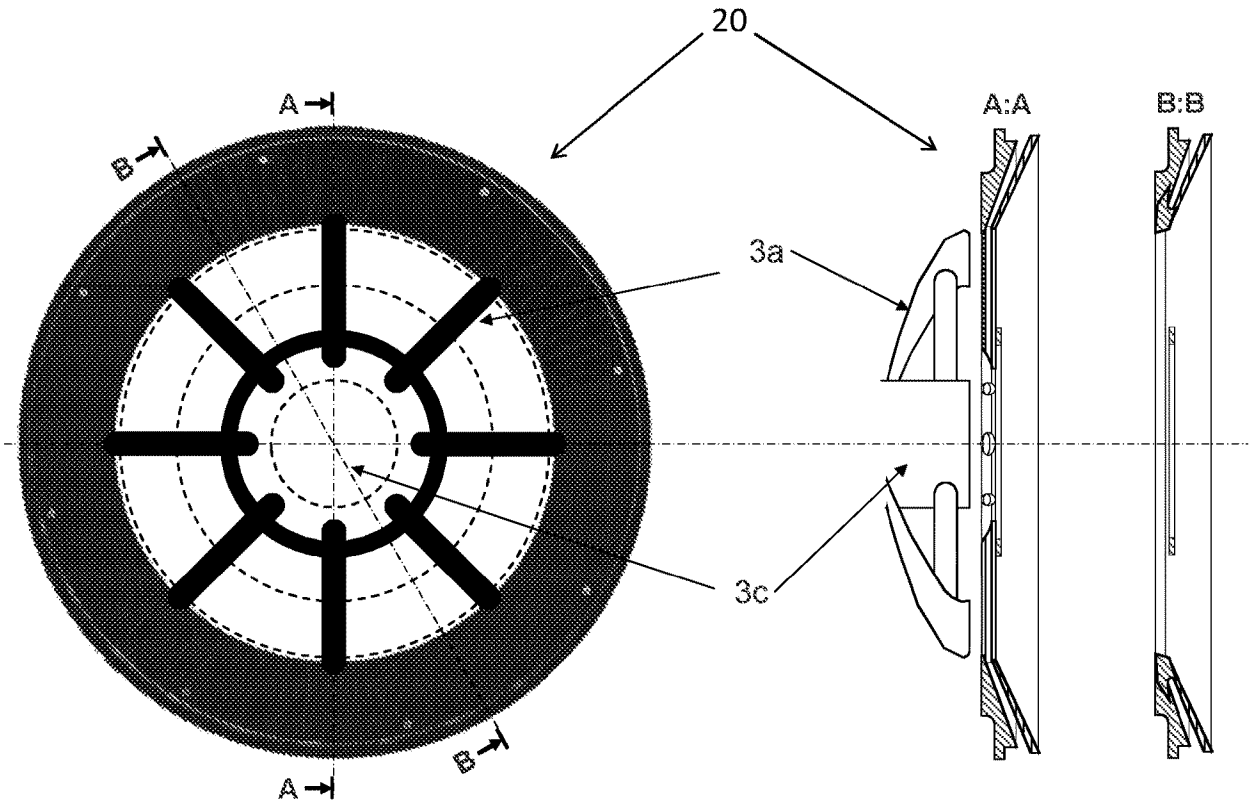

FIGS. 5*b-d* illustrate different embodiments of a center ring 20 according to the present disclosure. As illustrated in the figures, the number of steam evacuating channels 21 may vary between different embodiments as well as the length of the steam evacuating channels 21. By adjusting the number and the length of the channels 21, properties such as the amount of evacuated steam and the steam release radius can be adjusted depending on e.g. the radius of the feed screw and the amount of incoming fibrous material etc.

All embodiments of the present disclosure can be fitted to a defibrator arrangement of well-known pulp/fiber refiners, for example refiners with a rotor-stator arrangement as described above, as well as refiners with two rotors instead of a rotor-stator arrangement, i.e. two rotors that can be rotated independently.

The embodiments described above are merely given as examples, and it should be understood that the proposed technology is not limited thereto. It will be understood by those skilled in the art that various modifications, combinations and changes may be made to the embodiments without departing from the present scope as defined by the appended claims. In particular, different part solutions in the different embodiments can be combined in other configurations, where technically possible.

The invention claimed is:

1. A first refining disc for a defibrator for refining fibrous material, the first refining disc including a central material inlet opening adapted to receive a flow of incoming fibrous material from a feed screw and a refining surface disposed outwardly from the central material inlet opening, the first refining disc including at least one steam evacuating channel comprising at least one steam inlet opening arranged on a side of the first refining disc adapted to face a second refining disc, and at least one steam outlet opening arranged on a side of the first refining disc adapted to face away from the second refining disc, the at least one steam outlet opening being arranged centrally of the at least one steam inlet opening inwardly with respect to the refining surface, wherein the at least one steam outlet opening is arranged centrally of a position where the flow of incoming material is to be received into the first refining disc from the feed screw, with respect to the center of the first refining disc.

2. The first refining disc according to claim 1, wherein the at least one steam inlet opening is arranged centrally of a refining segment of the first refining disc with respect to the center of the first refining disc.

3. The first refining disc according to claim 1, wherein the at least one steam inlet opening comprises an edge which extends into a space between the first refining disc and the second refining disc.

4. The first refining disc according to claim 1, wherein at least a part of the at least one steam evacuating channel is arranged at an acute angle with respect to an inner surface of the first refining disc, and wherein the inner surface of the first refining disc is adapted to face the second refining disc.

5. The first refining disc according to claim 4, wherein a first part of the at least one steam evacuating channel as seen from the steam inlet opening is arranged at an acute angle with respect to the inner surface of the first refining disc.

6. The first refining disc according to claim 1, wherein the first refining disc includes a center ring arranged with its rotational center coinciding with the rotational center of the first refining disc on a side of the first refining disc adapted to face the second refining disc, wherein the at least one steam evacuating channel is provided in the center ring.

7. The first refining disc according to claim 1, wherein the first refining disc is a stator in a defibrator.

* * * * *